US011719471B2

(12) United States Patent
Nalamwar et al.

(10) Patent No.: US 11,719,471 B2
(45) Date of Patent: Aug. 8, 2023

(54) ENERGY EFFICIENT HEAT PUMP WITH HEAT EXCHANGER COUNTERFLOW ARRANGEMENT

(71) Applicant: Johnson Controls Tyco IP Holdings LLP, Milwaukee, WI (US)

(72) Inventors: Pankaj Digambar Nalamwar, Digras (IN); Anand Mallinath Dulange, Solapur (IN); Dnyaneshwar Gorakshanath Rokade, Pune (IN); Hambirarao Sayajirao Sawant, Pune (IN)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 0 days.

(21) Appl. No.: 17/936,716

(22) Filed: Sep. 29, 2022

(65) Prior Publication Data

US 2023/0096259 A1 Mar. 30, 2023

(30) Foreign Application Priority Data

Sep. 29, 2021 (IN) ..... 202121044102

(51) Int. Cl.
*F25B 13/00* (2006.01)
*F25B 30/02* (2006.01)
*F25B 41/31* (2021.01)

(52) U.S. Cl.
CPC ..... *F25B 13/00* (2013.01); *F25B 30/02* (2013.01); *F25B 41/31* (2021.01); *F25B 2500/09* (2013.01); *F25B 2600/2513* (2013.01)

(58) Field of Classification Search
CPC ..... F25B 13/00; F25B 30/02; F25B 41/31; F25B 2500/09; F25B 2600/2513
See application file for complete search history.

(56) References Cited

U.S. PATENT DOCUMENTS 4,646,537 A * 3/1987 Crawford ..... F25B 13/00 62/238.7
5,165,254 A * 11/1992 Kountz ..... F25B 39/00 62/324.6
8,539,789 B2 9/2013 Kopko et al.
(Continued)

FOREIGN PATENT DOCUMENTS

CN 114542555 A 5/2022
WO 2022007739 A1 1/2022
WO 2022017297 A1 1/2022

*Primary Examiner* — Henry T Crenshaw
(74) *Attorney, Agent, or Firm* — Fletcher Yoder, P.C.

(57) ABSTRACT

An energy efficient heat pump for a heating, ventilation, and air conditioning (HVAC) system includes a vapor compression circuit, a heat exchanger of the vapor compression circuit configured to place a working fluid in a heat exchange relationship with an air flow directed across the heat exchanger, and a conduit system of the vapor compression circuit. The conduit system of the vapor compression circuit is configured to direct the working fluid into the heat exchanger and to receive the working fluid from the heat exchanger, wherein the conduit system is configured to direct the working fluid into the heat exchanger to place the working fluid in a counterflow arrangement with the air flow directed across the heat exchanger in a cooling mode of the heat pump and in a heating mode of the heat pump.

20 Claims, 7 Drawing Sheets

(56) References Cited

U.S. PATENT DOCUMENTS

| | | | | |
|---|---|---|---|---|
| 9,752,803 | B2 | 9/2017 | Matter, III et al. | |
| 9,816,402 | B2 | 11/2017 | Kauffman et al. | |
| 10,317,112 | B2 | 6/2019 | Kopko | |
| 10,704,810 | B2 | 7/2020 | Snell et al. | |
| 10,907,865 | B2 * | 2/2021 | Baker | F25B 13/00 |
| 10,914,503 | B2 | 2/2021 | Walser | |
| 10,948,203 | B2 | 3/2021 | Blanton | |
| 11,073,301 | B2 | 7/2021 | Singh et al. | |
| 11,486,612 | B2 | 11/2022 | Brillhart | |
| 2004/0025526 | A1 * | 2/2004 | Aflekt | F25B 40/00 62/324.1 |
| 2013/0255308 | A1 | 10/2013 | De Larminat | |
| 2015/0285539 | A1 * | 10/2015 | Kopko | F25B 41/39 62/324.1 |
| 2019/0376697 | A1 * | 12/2019 | Ray | F24F 13/20 |
| 2020/0240680 | A1 | 7/2020 | Lv et al. | |
| 2021/0063092 | A1 * | 3/2021 | Decker | F28D 15/02 |
| 2022/0128274 | A1 | 4/2022 | Kopko et al. | |
| 2022/0397313 | A1 | 12/2022 | Pickle et al. | |
| 2022/0397314 | A1 | 12/2022 | Pickle et al. | |

* cited by examiner

ENERGY EFFICIENT HEAT PUMP WITH HEAT EXCHANGER COUNTERFLOW ARRANGEMENT

CROSS REFERENCE TO RELATED APPLICATION

This application claims priority from and the benefit of India Provisional Patent Application No. 202121044102, entitled "AN ARRANGEMENT FOR AN HVAC UNIT," filed Sep. 29, 2021, which is hereby incorporated by reference in its entirety for all purpose.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Embodiments of the present disclosure are directed to heating, ventilation, and/or air conditioning (HVAC) systems with improved heat exchange efficiency. More particularly, embodiments of the present disclosure are directed to reducing energy consumption by employing a counterflow heat transfer arrangement, which limits corresponding emissions.

HVAC systems are utilized in residential, commercial, and industrial environments to control environmental properties, such as temperature and humidity, for occupants of the respective environments. An HVAC system may control environmental properties by controlling a supply air flow delivered to the environment. For example, the HVAC system may place the supply air flow in a heat exchange relationship with a working fluid of a vapor compression circuit to condition the supply air flow. In some instances, an HVAC system may be configured as a heat pump. The heat pump may operate in a heating mode and in a cooling mode. That is, the heat pump may operate in the heating mode to heat a supply air flow, and the heat pump may operate in the cooling mode to cool the supply air flow. The heat pump may direct a working fluid through a vapor compression circuit in different directions to enable operation in the cooling mode and in the heating mode. Unfortunately, existing heat pumps may operate inefficiently in the heating mode, the cooling mode, or both. It is now recognized that such inefficiencies can result in unnecessary energy consumption and associated emissions.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, an energy efficient heat pump for a heating, ventilation, and air conditioning (HVAC) system includes a vapor compression circuit, a heat exchanger of the vapor compression circuit configured to place a working fluid in a heat exchange relationship with an air flow directed across the heat exchanger, and a conduit system of the vapor compression circuit. The conduit system of the vapor compression circuit is configured to direct the working fluid into the heat exchanger and to receive the working fluid from the heat exchanger, wherein the conduit system is configured to direct the working fluid into the heat exchanger to place the working fluid in a counterflow arrangement with the air flow directed across the heat exchanger in a cooling mode of the heat pump and in a heating mode of the heat pump.

In another embodiment, an energy efficient heat pump for a heating, ventilation, and air conditioning (HVAC) system includes a vapor compression circuit and a heat exchanger disposed along the vapor compression circuit. The heat exchanger includes an inlet, an outlet, and a plurality of tubes configured to direct a working fluid therethrough, and the heat exchanger is configured to place the working fluid in a heat exchange relationship with an air flow directed across the heat exchanger in a first direction. In a heating mode and in a cooling mode of the heat pump, the vapor compression circuit is configured to direct the working fluid into the plurality of tubes via the inlet, the outlet is configured to discharge the working fluid from the heat exchanger, and the plurality of tubes is configured to direct the working fluid through the heat exchanger in a second direction opposite the first direction.

In a further embodiment, an energy efficient heat pump for a heating, ventilation, and air conditioning (HVAC) system includes a vapor compression circuit having a compressor, a first heat exchanger, a second heat exchanger, and an expansion valve. The first heat exchanger includes an inlet configured to receive a working fluid from the vapor compression circuit, a plurality of tubes configured to circulate the working fluid through the heat exchanger, and an outlet configured to discharge the working fluid from the heat exchanger. The vapor compression circuit includes a conduit system configured to direct the working fluid into the plurality of tubes via the inlet in a heating mode of the heat pump and in a cooling mode of the heat pump.

DETAILED DESCRIPTION

Figure 1:
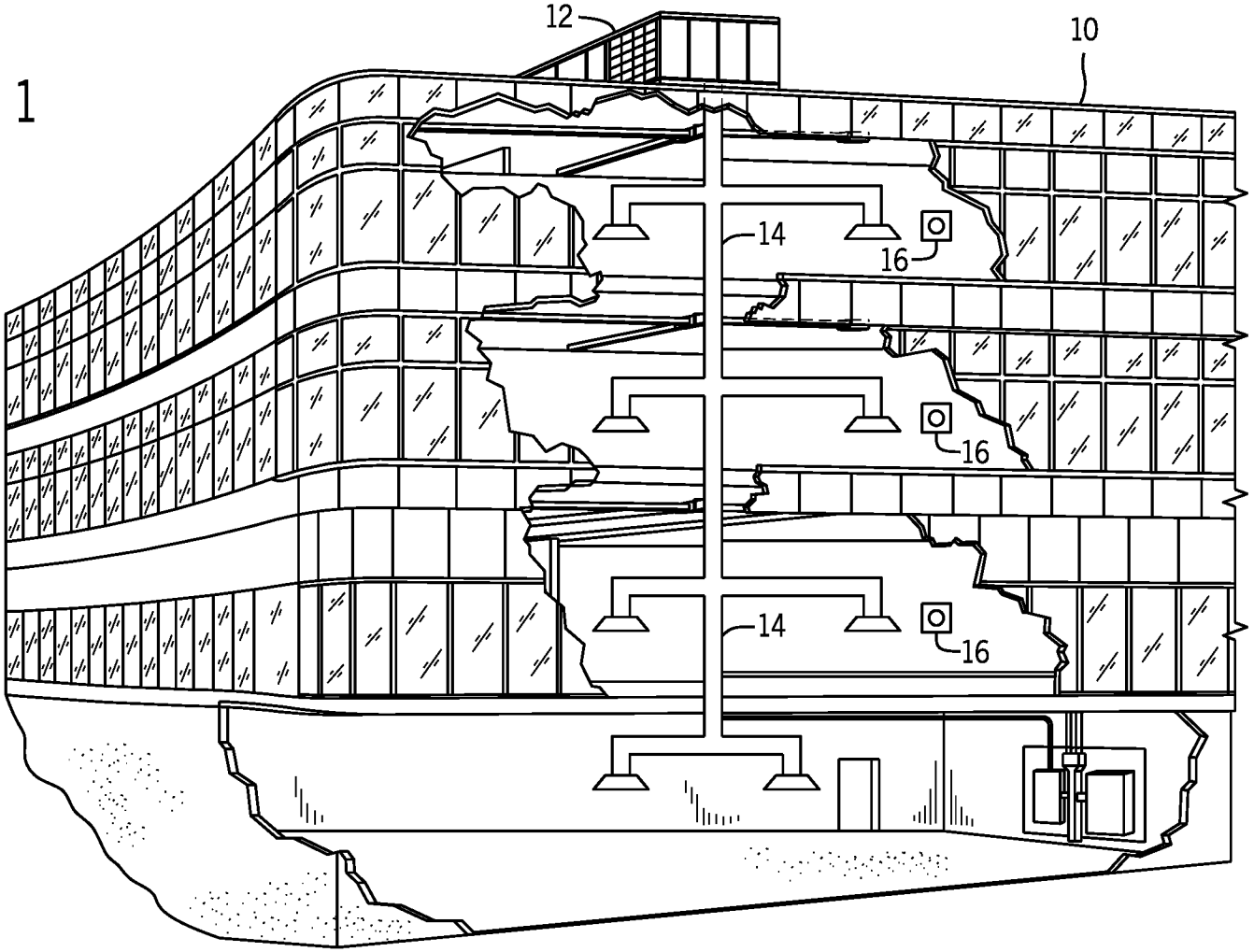
FIG. 1 is a perspective view of an embodiment of a heating, ventilation, and/or air conditioning (HVAC) system for environmental management including an HVAC unit, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to regulate environmental parameters (e.g., temperature, humidity) within a space to be conditioned, such as a building, home, storage space, or other suitable structure. For example, the HVAC system may include a vapor compression circuit configured to transfer thermal energy between a working fluid, such as a refrigerant, and a fluid to be conditioned, such as air. The vapor compression circuit includes heat exchangers, such as a condenser and an evaporator, which are fluidly coupled to one another via one or more conduits of a working fluid loop or circuit. A compressor may be used to circulate the working fluid through the conduits and other components of the vapor compression circuit (e.g., an expansion device) and, thus, enable the transfer of thermal energy between components of the vapor compression circuit (e.g., between the condenser and the evaporator) and one or more thermal loads (e.g., an environmental air flow, a supply air flow).

Additionally or alternatively, the HVAC system may include a heat pump (e.g., a heat pump system) having a first heat exchanger (e.g., a heating and/or cooling coil, an indoor coil, an evaporator) that may be positioned within the space to be conditioned, a second heat exchanger (e.g., a heating and/or cooling coil, an outdoor coil, a condenser) that may be positioned in or otherwise fluidly coupled to an ambient environment (e.g., the atmosphere), and a pump (e.g., a compressor) configured to circulate the working fluid (e.g., refrigerant) between the first and second heat exchangers to enable heat transfer between the thermal load and the ambient environment, for example. The heat pump may be operable in different modes to selectively provide cooling and heating to the space to be conditioned (e.g., a room, zone, or other region within a building) by adjusting a flow (e.g., a direction of flow) of the working fluid through the vapor compression circuit. For example, the heat pump may be a central HVAC system configured to generate and discharge a conditioned air flow to be distributed to a conditioned space or a plurality of conditioned spaces (e.g., rooms, zones) via an air distribution system, such as ductwork. As will be appreciated, the heat pump may be configured to circulate the working fluid in different directions to enable operation of the heat pump in different modes. For example, in a heating mode (e.g., to heat a supply air flow provided to a conditioned space), the heat pump may circulate the working fluid through the vapor compression circuit in a first direction, and in a cooling mode (e.g., to cool a supply air flow provided to a conditioned space), the heat pump may circulate the working fluid through the vapor compression circuit in a second direction that is opposite the first direction. Thus, the heat pump may not include a dedicated heating system, such as a furnace or burner configured to combust a fuel, to enable operation of the HVAC system in the heating mode. As a result, the heat pump operates with reduced greenhouse gas emissions.

Performance (e.g., efficiency) of a heat pump may be affected by an arrangement or configuration of components of the heat pump. As mentioned above, a heat exchanger of the heat pump may be configured to enable heat transfer between a working fluid circulated through the heat exchanger and an air flow directed across the heat exchanger. In general, the heat exchanger may operate more efficiently when the heat exchanger is configured to direct the working fluid through the heat exchanger and the air flow across the heat exchanger in opposite flow directions. Such an arrangement or configuration may be referred to as a counterflow arrangement (e.g., counterflow heat transfer arrangement). Conversely, the heat exchanger may operate less efficiently in a parallel flow arrangement in which the working fluid is directed through the heat exchanger and the air flow is directed across the heat exchanger in a common direction.

In traditional HVAC systems, the heat exchanger may be arranged such that the air flow travels across the heat exchanger in a predefined (e.g., predetermined) or generally fixed direction. Indeed, in traditional heat pumps, the air flow may be directed across the heat exchanger in the predefined direction in both a heating mode and a cooling mode of the heat pump. Thus, heat exchangers of traditional heat pumps place a working fluid and an air flow in a counterflow arrangement in one operating mode (e.g., cooling mode) and in a parallel flow arrangement in another operating mode (e.g., heating mode). Unfortunately, as discussed above, efficiency of heat exchangers operating in a parallel flow arrangement is limited. For example, traditional heat pumps that operate in a cooling mode with a counterflow arrangement and in a heating mode in a parallel flow arrangement may have limited efficiency (e.g., energy efficiency, heat transfer efficiency) in the heating mode.

Accordingly, it is now recognized that improved HVAC systems, including heat pumps, are desired. The present disclosure is directed to an improved heat pump that is configured to place a supply air flow and a working fluid in a counterflow arrangement in both a cooling mode and a heating mode of the heat pump. For example, the heat pump may include a vapor compression circuit with a conduit system configured to direct a working fluid through the heat exchanger in a flow direction that is opposite a flow direction of the supply air flow in both the cooling mode and the heating mode. As discussed in further detail below, the conduit system may include one or more flow paths and one or more valves (e.g., check valve) configured to direct the working fluid through the heat exchanger in a counterflow arrangement with the supply air flow in both the cooling mode and the heating mode. Indeed, while the heat pump may generally direct the working fluid through the vapor compression circuit in opposite directions in the cooling mode and heating mode, the conduit system may nevertheless enable flow of the working fluid through the heat exchanger in a counterflow arrangement with the supply air flow in both modes. In this way, the heat pump may operate more efficiently (e.g., with improved heat transfer, with reduced energy consumption) in a cooling mode and in a heating mode.

As discussed above, heat pumps include a vapor compression circuit having a first heat exchanger and a second heat exchanger. In some embodiments, the heat pump may be a single packaged unit having the first heat exchanger and the second heat exchanger. In other embodiments, the heat pump may be a split system having the first heat exchanger and the second heat exchanger in separate units (e.g., an indoor unit and an outdoor unit). In any case, the techniques disclosed herein (e.g., the conduit system) may be implemented to enable a counterflow arrangement in a heating mode and in a cooling mode of the heat pump for the first heat exchanger, the second heat exchanger, or both. For example, the heat pump may include a first conduit system configured to enable a counterflow arrangement in the first heat exchanger in both the heating mode and the cooling mode and/or may include a second conduit system configured to enable a counterflow arrangement in the second heat exchanger in both the heating mode and the cooling mode. By enabling and providing a counterflow heat transfer arrangement between a working fluid and an air flow (e.g., a supply air flow provided to conditioned space) in both the heating mode and the cooling mode, heat pumps incorporating the disclosed techniques may operate with improved heat transfer efficiency, reduced energy consumption, and greater overall HVAC system efficiency. Indeed, heat pumps incorporating the present techniques are configured to heat an air flow in an energy efficient manner and without operation of a furnace or other heating system configured to combust or consume a fuel and thereby provide a reduction of greenhouse gas emissions.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor unit 58 and an indoor unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building 10 with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building 10 control or monitoring systems, and even systems that are remote from the building 10.

Figure 2:
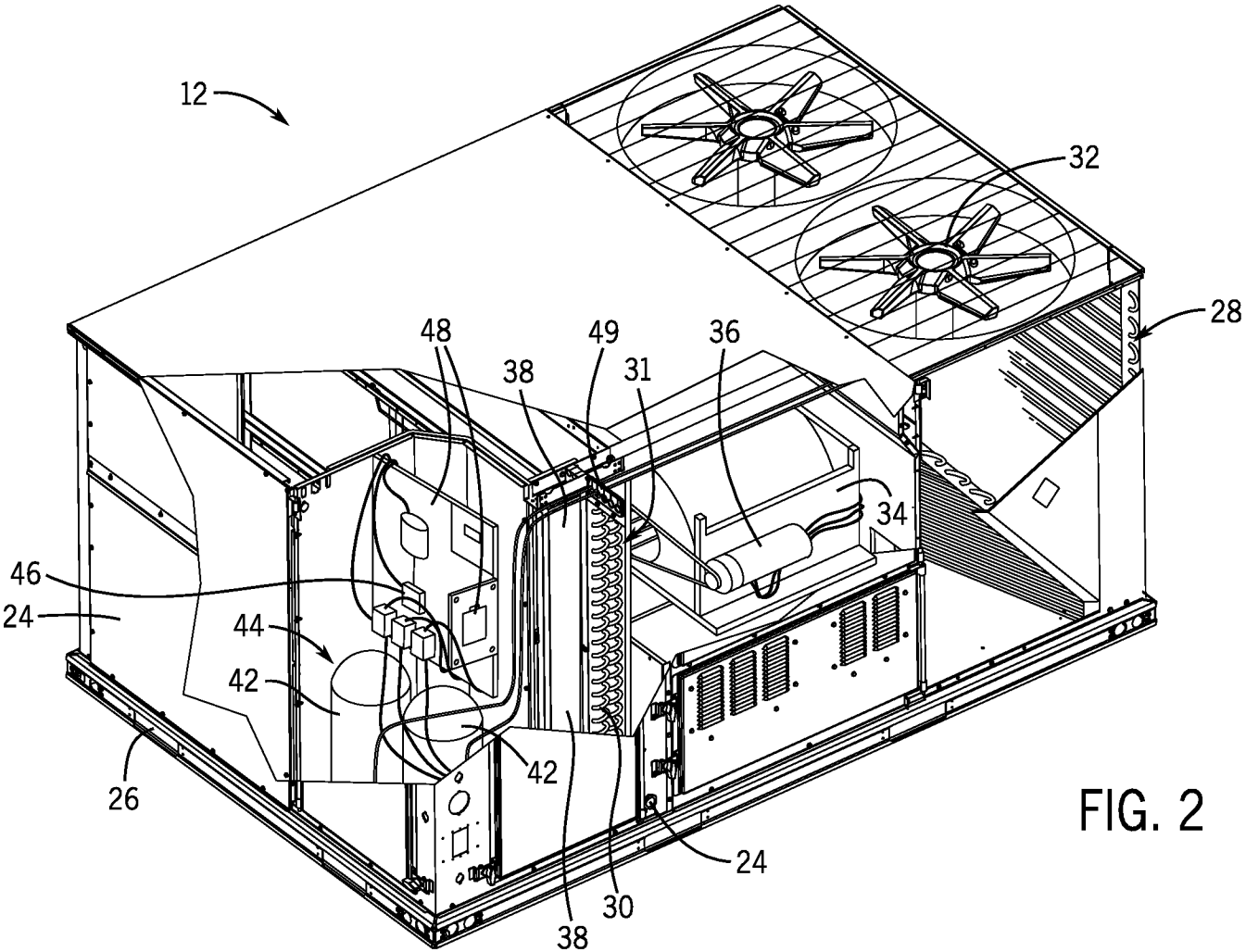
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
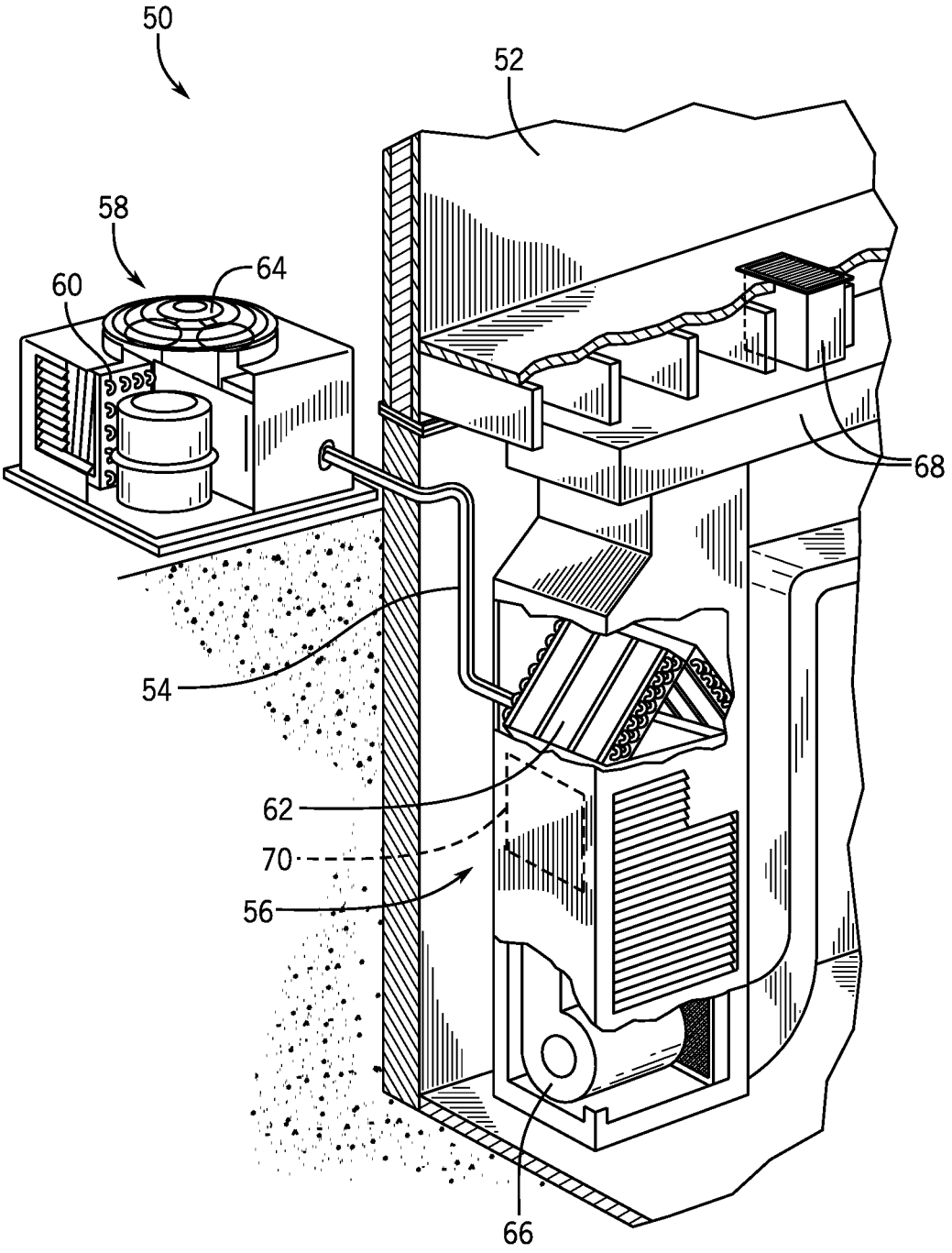
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
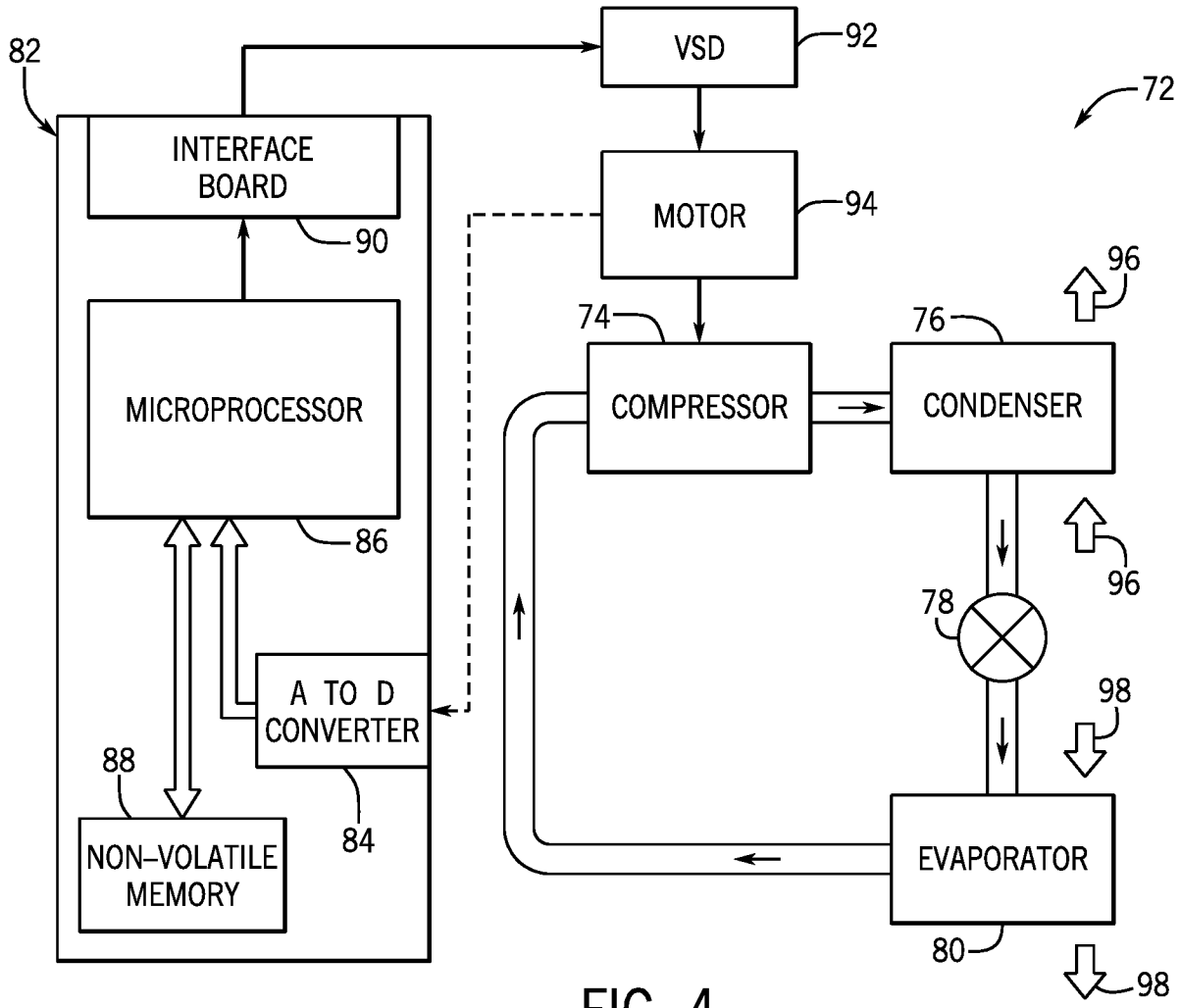
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD 92 or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building 10, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building 10 or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, embodiments of the present disclosure are directed to an HVAC system configured to place a working fluid and an air flow in a counterflow arrangement in both a heating mode and a cooling mode of the HVAC system. For example, the HVAC system may be a heat pump (e.g., a central HVAC system) configured to operating in the heating mode and the cooling mode. The heat pump may include a vapor compression circuit configured to circulate the working fluid therethrough in a first direction in the heating mode and a second direction, opposite the first direction, in the cooling mode. The vapor compression circuit may further include a conduit system configured to place the working fluid in a counterflow arrangement with the air flow (e.g., via a heat exchanger of the vapor compression circuit) in both the heating mode and the cooling mode. By enabling and providing a counterflow heat transfer arrangement between the working fluid and the air flow in both the heating mode and the cooling mode, the vapor compression circuit (e.g., heat pump) may operate with improved heat transfer efficiency, reduced energy consumption, and greater overall HVAC system efficiency.

Figure 5:
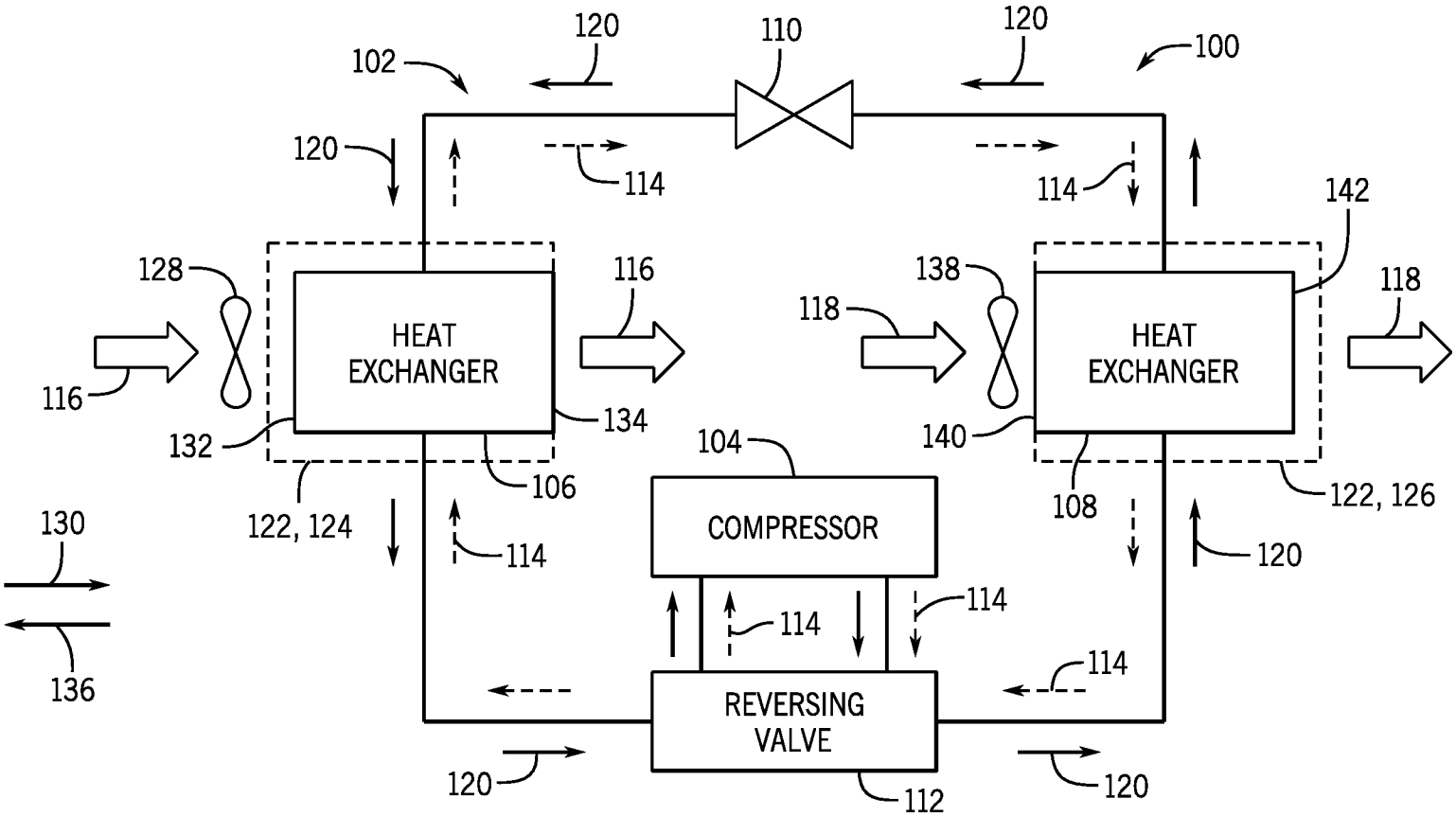
FIG. 5 is a schematic of an embodiment of a vapor compression circuit of an HVAC system configured to operate in a cooling mode and in a heating mode, in accordance with an aspect of the present disclosure.

To provide context to the following discussion, FIG. 5 is a schematic of an embodiment of an HVAC system 100 (e.g., a heat pump, a central HVAC system) having a vapor compression circuit 102 configured to operating in a heating mode and in a cooling mode, in accordance with the present techniques. As similarly described above, the vapor compression circuit 102 may include a compressor 104, a first heat exchanger 106, a second heat exchanger 108, and an expansion device 110 (e.g., expansion valve, one or more expansion valves). For example, the HVAC system 100 may be an embodiment of the HVAC unit 12 or the residential heating and cooling system 50 discussed above. In some embodiments, the HVAC system 100 may be a central HVAC system configured to condition an air flow (e.g., a supply air flow) by heating and/or cooling the air flow and to discharge the air flow for distribution within a conditioned space, such as the building 10, a home, a plurality of rooms, a plurality of zones, or other space to be conditioned via the air flow.

The vapor compression circuit 102 also includes a reversing valve 112. The reversing valve 112 is configured to enable operation of the vapor compression circuit 102 in the heating mode and in the cooling mode. Specifically, the reversing valve 112 is configured to adjust a flow direction of the working fluid through the vapor compression circuit 102 to enable adjustment of an operating mode of the HVAC system 100. For example, in a heating mode, the reversing valve 112 may be adjusted to enable flow of a working fluid through the vapor compression circuit 102 in a first direction, as indicated by arrows 114 (e.g., along a heating flow path, in a first flow direction). In other words, in the heating mode, the reversing valve 112 may enable the working fluid to flow sequentially through the compressor 104, the first heat exchanger 106, the expansion device 110, and the second heat exchanger 108. Thus, the first heat exchanger 106 (e.g., indoor heat exchanger) may operate as a condenser, and the second heat exchanger 108 (e.g., outdoor heat exchanger) may operate as an evaporator. In this way, the first heat exchanger 106 may operate to heat an air flow 116 (e.g., indoor air flow, first air flow, supply air flow) directed across the first heat exchanger 106, while the second heat exchanger 108 may reject heat to an air flow 118 (e.g., outdoor air flow, ambient air flow, first air flow) directed across the second heat exchanger 108.

Conversely, in the cooling mode, the reversing valve 112 may be adjusted to enable flow of the working fluid through the vapor compression circuit 102 in a second direction, as indicated by arrows 120 (e.g., along a cooling flow path, in a second flow direction), to cause the working fluid to flow sequentially through the compressor 104, the second heat exchanger 108, the expansion device 110, and the first heat exchanger 106. Thus, the second heat exchanger 108 (e.g., outdoor heat exchanger) may operate as a condenser, and the first heat exchanger 106 (e.g., indoor heat exchanger) may operate as an evaporator. In this way, the second heat exchanger 108 may operate to reject heat to the air flow 118, and the first heat exchanger 106 may operate to cool the air flow 116.

As mentioned above, the HVAC system 100 is configured to place a working fluid circulated by the vapor compression circuit 102 and an air flow in a counterflow arrangement in both a heating mode and a cooling mode of the HVAC system 100. For example, the HVAC system 100 may be configured to place the working fluid directed through the first heat exchanger 106 in a counterflow arrangement with the air flow 116, and/or the HVAC system 100 may be configured to place the working fluid directed through the second heat exchanger 108 in a counterflow arrangement with the air flow 118 in both of the heating mode and the cooling mode of the HVAC system 100. To this end, the HVAC system 100 (e.g., the vapor compression circuit 102) includes one or more conduit systems 122. In some embodiments, the vapor compression circuit 102 may include a first conduit system 124 configured to place the working fluid directed through the first heat exchanger 106 in counterflow arrangement with the air flow 116 in both the heating mode and the cooling mode. Additionally or alternatively, the vapor compression circuit 102 may include a second conduit system 126 configured to place the working fluid directed through the second heat exchanger 108 in counterflow arrangement with the air flow 118 in both the heating mode and the cooling mode.

In the illustrated embodiment, the HVAC system 100 includes a first fan 128 configured to direct the air flow 116 across the first heat exchanger 106 in a first direction 130. That is, the first fan 128 forces the air flow 116 across the first heat exchanger 106 from a first end 132 (e.g., upstream end) to a second end 134 (e.g., downstream end) of the first heat exchanger 106. As described in further detail below, the first conduit system 124 is configured to direct the working fluid through the first heat exchanger 106 in a second direction 136 opposite the first direction 130. The first conduit system 124 may include one or more conduits, manifolds, valves, flow paths, and so forth configured to enable flow of the working fluid through the first heat exchanger 106 in the second direction 136 in both the heating mode and the cooling mode. That is, the first conduit system 124 is configured to direct the working fluid into the first heat exchanger 106 at the second end 134 and receive the working fluid from the first heat exchanger 106 at the first end 132 in both the heating mode and the cooling mode of the HVAC system 100. In this way, the first conduit system 124 of the vapor compression circuit 102 is configured to establish a counterflow arrangement of the working fluid and the air flow 116 at the first heat exchanger 106 in the heating mode and the cooling mode.

In some embodiments, the vapor compression circuit 102 may similarly include the second conduit system 126, which may establish a similar counterflow arrangement between the working fluid and the air flow 118 directed across the second heat exchanger 108. As shown, the HVAC system 100 includes a second fan 138 configured to direct the air flow 118 across the second heat exchanger 108 in the first direction 130 (e.g., from a first end 140 of the second heat exchanger 108 to a second end 142 of the second heat exchanger 108). To establish the counterflow arrangement, the second conduit system 126 may be configured to direct the working fluid into the second heat exchanger 108 at the second end 142 and receive the working fluid from the second heat exchanger 108 at the first end 140 in both the heating mode and the cooling mode of the HVAC system 100, as similarly described above.

While the illustrated embodiment includes the first conduit system 124 associated with the first heat exchanger 106 and the second conduit system 126 associated with the second heat exchanger 108 to establish counterflow arrangements between the working fluid and a respective air flow, it should be appreciated that, in some embodiments, the first heat exchanger 106 or the second heat exchanger 108 may not be associated with an embodiment of the conduit system 122. For example, in some embodiments, the vapor compression circuit 102 may include the first conduit system 124 associated with the first heat exchanger 106, which may be an indoor heat exchanger configured to condition a supply air flow (e.g., air flow 116), and the vapor compression circuit 102 may not include the second conduit system 126 associated with the second heat exchanger 108, which may be an outdoor heat exchanger configured to exchange heat with an ambient air flow (e.g., air flow 118). In such an embodiment, the vapor compression circuit 102 may include the conduit system 122 configured to establish a counterflow arrangement between the working fluid and the air flow 116 via the first heat exchanger 106 in both the heating mode and the cooling mode, while the second heat exchanger 108 may not include the conduit system 122 and may establish a counterflow arrangement between the working fluid and the air flow 118 in one mode of the HVAC system 100 (e.g., cooling mode) and establish a parallel flow arrangement between the working fluid and the air flow 118 in another mode of the HVAC system 100 (e.g., heating mode). As will be appreciated, in a parallel flow arrangement of the second heat exchanger 108, the working fluid may be directed into the second heat exchanger 108 at the first end 140 and discharged from the second heat exchanger 108 at the second end 142, such that the working fluid and the air flow 118 are both directed across the second heat exchanger 108 in the first direction 130. In other embodiments, the vapor compression circuit 102 may include the second conduit system 126 associated with the second heat exchanger 108 and may not include the first conduit system 124 associated with the first heat exchanger 106, such that a counterflow arrangement is established between the working fluid and the air flow 118 in the heating mode and the cooling mode, while the first heat exchanger 106 may establish a counterflow arrangement between the working fluid and the air flow 116 in one mode (e.g., cooling mode) and establish a parallel flow arrangement between the working fluid and the air flow 116 in another mode (e.g., heating mode).

Figure 6:
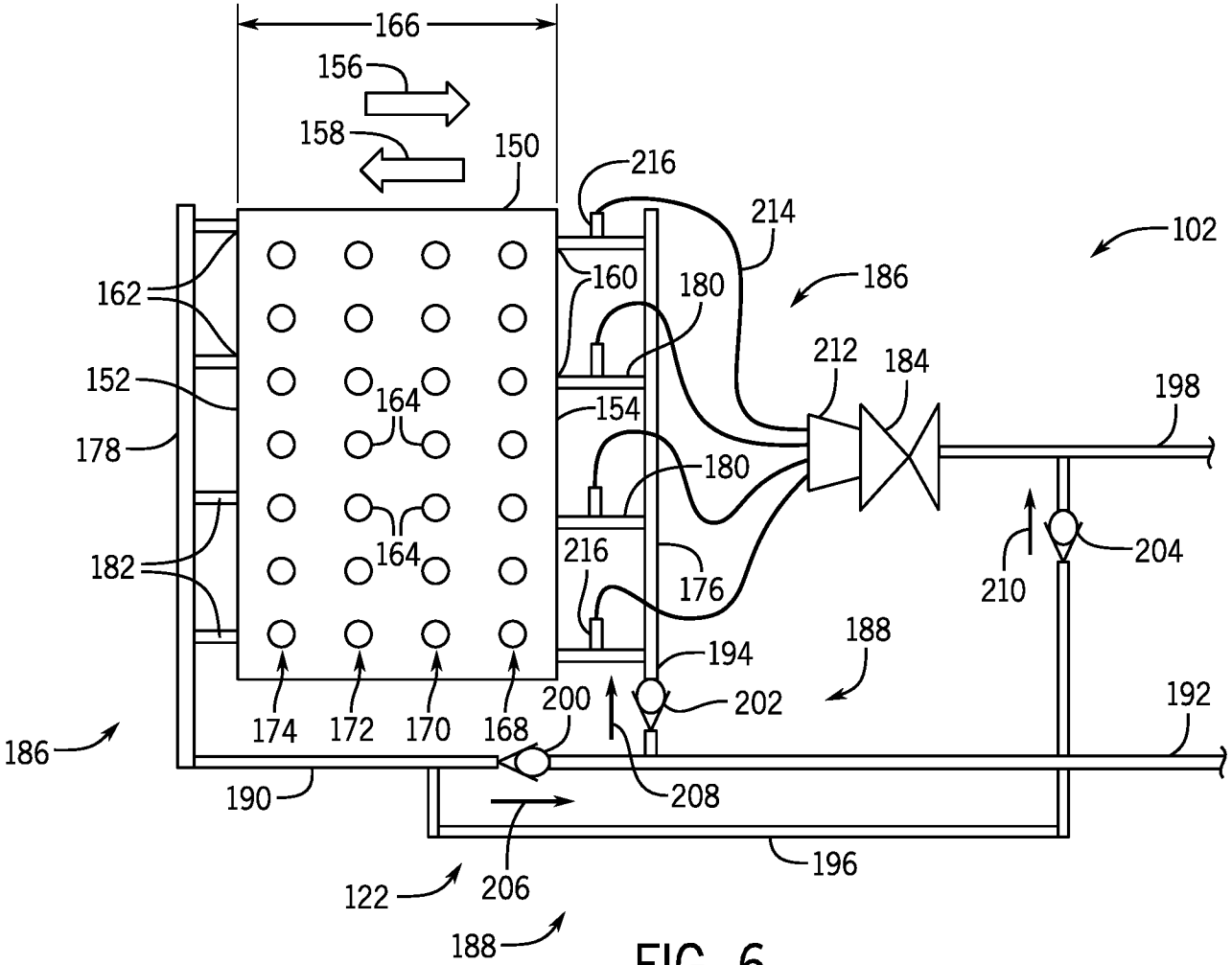
FIG. 6 is a schematic of an embodiment of a portion of a vapor compression circuit of an HVAC system, in accordance with an aspect of the present disclosure.

FIG. 6 is a schematic of an embodiment of a portion of the vapor compression circuit 102 of the HVAC system 100, illustrating an embodiment of the conduit system 122 associated with a heat exchanger 150 of the vapor compression circuit 102. The heat exchanger 150 may be the first heat exchanger 106, the second heat exchanger 108, an indoor heat exchanger, an outdoor heat exchanger, a heat exchanger configured to condition a supply air flow provided to a conditioned space, a heat exchanger configured to exchange heat with an ambient air flow, or any other suitable heat exchanger. As described above, the conduit system 122 is configured to enable the vapor compression circuit 102 to establish a counterflow heat exchange relationship between a working fluid circulated through the heat exchanger 150 and an air flow directed across the heat exchanger 150 in both a heating mode and a cooling mode of the HVAC system 100, thereby improving the efficiency of the HVAC system 100 (e.g., increased heat transfer efficiency, increased energy efficiency, reduced energy consumption).

In the illustrated embodiment, the heat exchanger 150 includes a first end 152 (e.g., an upstream end, first side) and a second end 154 (e.g., a downstream end, second side). During operation of the HVAC system 100 in each of the heating mode and the cooling mode, an air flow may be directed across the heat exchanger 150 in a first direction 156 from the first end 152 to the second end 154. In each of the heating mode and the cooling mode, the conduit system 122 is configured to direct the working fluid into the heat exchanger 150 to establish a counterflow relationship with the air flow even though the vapor compression circuit 102 may generally direct the working fluid therethrough in one direction in one mode and in an opposite direction in the other mode. That is, the conduit system 122 is configured to direct the working fluid into the heat exchanger 150 at the second end 154 and to receive the working fluid from the heat exchanger 150 at the first end 152, such that the working fluid flows through the heat exchanger 150 in a second direction 158 opposite the first direction 156. In this way, the conduit system 122 is configured to enable more efficient heat exchange between the working fluid and the air flow (e.g., compared to a parallel flow arrangement) in both the heating mode and the cooling mode, thereby improving overall heat transfer and energy efficiency of the HVAC system 100. Indeed, the vapor compression circuit 102 having the conduit system 122 is configured to operate with reduced greenhouse gas emissions by operating to heat and cool an air flow in an energy efficient manner and without operation of a furnace or other system that consumes a fuel.

The heat exchanger 150 includes one or more inlet ports 160 at the second end 154 that are configured to receive the working fluid, and the heat exchanger 150 includes one or more outlet ports 162 at the first end 152 that are configured to discharge the working fluid from the heat exchanger 150. In some embodiments, the heat exchanger 150 may be a tube and fin type heat exchanger. The heat exchanger 150 may include one or more tubes 164 configured to direct working fluid therethrough and one or more fins attached to the tubes 164. The tubes 164 cooperatively extend from the inlet ports 160 to the outlet ports 162, such that the tubes 164 direct the working fluid from the second end 154 to the first end 152 in the second direction 158. In some embodiments, the tubes 164 may be arranged in a plurality of rows arrayed along a width or depth 166 of the heat exchanger 150. For example, in the illustrated embodiment, working fluid may be directed from the conduit system 122, into the heat exchanger 150 via the inlet ports 160, and sequentially through a first row 168 of tubes 164, a second row 170 of tubes 164, a third row 172 of tubes 164, and a fourth row 174 of tubes 164. In this way, the working fluid flows through the tubes 164 of the heat exchanger 150 from the second end 154 to the first end 152 and in the second direction 158 (e.g., opposite the first direction 156 of the air flow directed across the heat exchanger 150). The fourth row 174 of tubes 164 may be fluidly coupled to the outlet ports 162, such that the working fluid may be discharged from the heat exchanger 150 via the outlet ports 162 and back to the conduit system 122 and the vapor compression circuit 102.

To enable the above-described functionality, the conduit system 122 defines multiple flow paths through which the working fluid may be directed along the vapor compression circuit 102, into the heat exchanger 150 at the second end 154, out of the heat exchanger 150 at the first end 152, and back to the vapor compression circuit 102. To this end, the conduit system 122 includes one or more conduits, valves, and/or other components configured to direct a working fluid therethrough. In some embodiments, the conduit system 122 may be at least partially defined by, and/or may include, components of the heat exchanger 150. Additionally or alternatively, the conduit system 122 may include components separate from the heat exchanger 150 (e.g., components of the vapor compression circuit 102) that are disposed along the vapor compression circuit 102 and are fluidly coupled to the heat exchanger 150. That is, the conduit system 122 may be considered as a portion of the heat exchanger 150, as a portion of the vapor compression circuit 102, or both.

In the illustrated embodiment, the conduit system 122 includes a first manifold 176 (e.g., first header, inlet header) fluidly coupled to the inlet ports 160 and includes a second manifold 178 fluidly coupled to the outlet ports 162. The conduit system 122 also includes a plurality of inlet conduits 180 extending from the first manifold 176 to the inlet ports 160. Each inlet port 160 may be associated with one of the tubes 164 of the heat exchanger 150. Thus, the conduit system 122 may direct the working fluid into the tubes 164 at the second end 154 of the heat exchanger 150 via the first manifold 176 and the inlet conduits 180. Similarly, the conduit system 122 includes a plurality of outlet conduits 182 extending from the outlet ports 162 to the second manifold 178. Each outlet port 162 may be associated with one of the tubes 164, such that working fluid may be discharged from the tubes 164 of the heat exchanger 150 via the outlet ports 162, the outlet conduits 182, and the second manifold 178. From the second manifold 178, the conduit system 122 may direct the working fluid to continue flowing along the vapor compression circuit 102.

As mentioned above, the conduit system 122 may define various flow paths to enable flow of the working fluid through the heat exchanger 150 in a counterflow arrangement with the air flow directed across the heat exchanger 150 (e.g., in the first direction 156) in each of the heating mode and the cooling mode of the HVAC system 100 (e.g., heat pump). To enable operation of the HVAC system 100 in the heating mode and the cooling mode, the vapor compression circuit 102 is configured to circulate the working fluid therethrough in different flow directions. As discussed above with reference to FIG. 5, the HVAC system 100 may direct the working fluid through the vapor compression circuit 102 in a first flow direction (e.g., indicated by arrows 114) in a cooling mode, and the HVAC system 100 may direct the working fluid through the vapor compression circuit 102 in a second flow direction (e.g., indicated by arrows 120) in a heating mode.

In the illustrated embodiment, the heat exchanger 150 may be configured to place the working fluid in a heat exchange relationship with an air flow (e.g., a supply air flow) to be conditioned and supplied to a conditioned space. For example, the heat exchanger 150 may be an indoor heat exchanger (e.g., indoor coil) disposed within a building having the conditioned space. Therefore, the heat exchanger 150 may receive the working fluid from an expansion device 184 (e.g., expansion device 110) of the vapor compression circuit 102 and operate as an evaporator to cool the air flow in a cooling mode of the HVAC system 100. In a heating mode of the HVAC system 100, the heat exchanger 150 may receive the working fluid from a compressor (e.g., compressor 104) of the vapor compression circuit 102 and operate as a condenser to heat the air flow. In either case, the conduit system 122 may direct the working fluid from the vapor compression circuit 102 and into the heat exchanger 150 via the inlet ports 160 at the second end 154. The working fluid may then flow through the tubes 164 in the second direction 158 and be discharged from the heat exchanger 150 via the outlet ports 162 at the first end 152, from which the conduit system 122 may direct the working fluid further along the vapor compression circuit 102.

To this end, the conduit system 122 is configured to enable flow of the working fluid through the heat exchanger 150 via a particular flow path of multiple flow paths defined by the conduit system 122 depending on the operating mode of the HVAC system 100. For example, in the cooling mode, the conduit system 122 may enable flow of the working fluid through the heat exchanger 150 via a first flow path 186 defined by the conduit system 122, and in the heating mode the conduit system 122 may enable flow of the working fluid through the heat exchanger 150 via a second flow path 188 defined by the conduit system 122. The first flow path 186 and the second flow path 188 may be defined by one or more conduits, valves, ports, manifolds, and/or other components of the conduit system 122. In some embodiments, certain components of the conduit system 122 may define portions of both the first flow path 186 and the second flow path 188.

For example, the illustrated embodiment the conduit system 122 includes the first manifold 176, a first conduit 190 (e.g., tube, pipe, flow path) extending from the second manifold 178 to a first circuit conduit 192 (e.g., tube, pipe, flow path) of the vapor compression circuit 102 (e.g., a suction line, extending the reversing valve 112), a second conduit 194 (e.g., tube, pipe, flow path) extending from the first conduit 190 to the first manifold 176, and a third conduit 196 (e.g., tube, pipe, flow path) extending from the first conduit 190 to a second circuit conduit 198 (e.g., tube, pipe, flow path) of the vapor compression circuit 102. The conduit system 122 also includes a first check valve 200 (e.g., non-return valve) disposed along the first conduit 190, a second check valve 202 disposed along the second conduit 194, and a third check valve 204 disposed along the third conduit 196. The first check valve 200 is configured to enable flow of working fluid along the first conduit 190 in a direction 206 (e.g., from the second manifold 178 toward the first circuit conduit 192) and to block flow of working fluid along the first conduit 190 in a direction opposite direction 206. Similarly, the second check valve 202 is configured to enable flow of working fluid along the second conduit 194 in a direction 208 (e.g., from the first conduit 190 toward the first manifold 176) and to block flow of working fluid along the second conduit 194 in a direction opposite direction 208. The third check valve 204 is configured to enable flow of working fluid along the third conduit 196 in a direction 210 (e.g., from the first conduit 190 toward the second circuit conduit 198) and to block flow of working fluid along the third conduit 196 in a direction opposite direction 210. Other embodiments of the conduit system 122 may include additional and/or alternative components.

The vapor compression circuit 102 further includes a distributor 212 disposed downstream of the expansion device 184 relative to a flow of working fluid through the expansion device 184. Distributor tubes 214 extend from the distributor 212 to inlet tubes 216 associated with the inlet conduits 180. That is, each distributor tube 214 may extend from the distributor 212 to one of the inlet tubes 216 associated with one of the inlet conduits 180 of the heat exchanger 150. In this way, the distributor 212 is configured to direct a flow of working fluid into the tubes 164 via the heat exchanger 150 at the second end 154 of the heat exchanger 150. In the manner described below, one or more components of the vapor compression system 102 and the conduit system 122 may define a particular flow path to direct working fluid through the heat exchanger 150 in the second direction 158 based on an operating mode (e.g., heating mode, cooling mode) of the HVAC system 100 to place the working fluid in a counterflow arrangement with the air flow directed across the heat exchanger 150.

Figure 7:
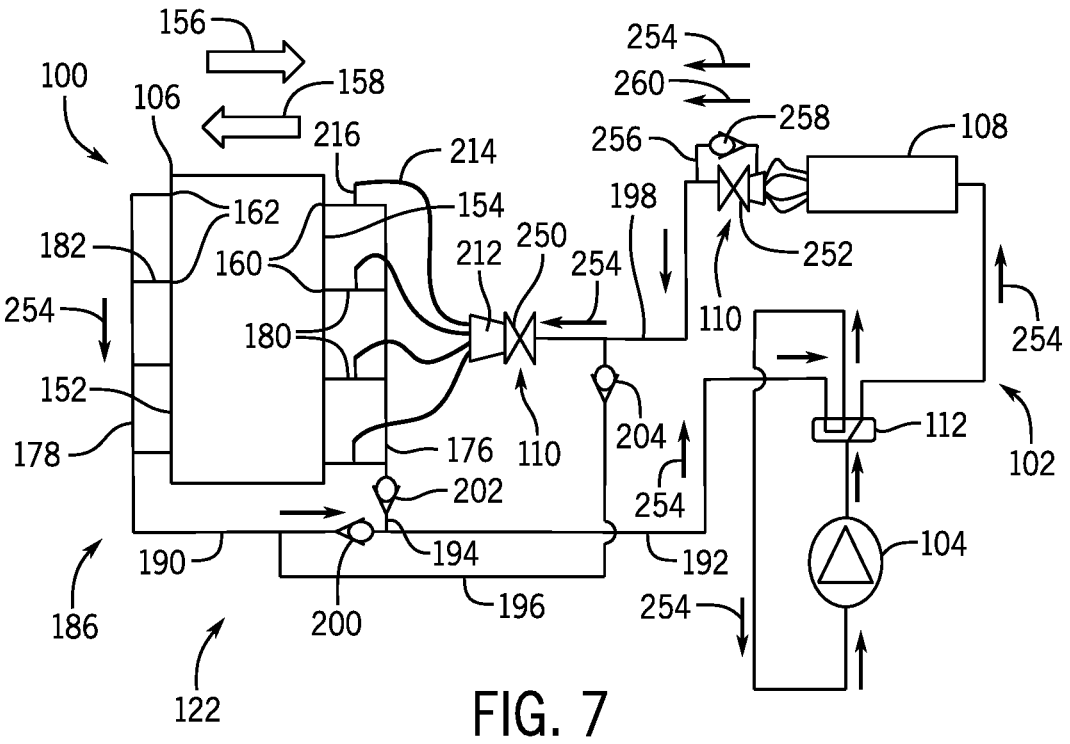
FIG. 7 is a schematic of an embodiment of a portion of a vapor compression circuit of an HVAC system, illustrating operation of the vapor compression circuit in a cooling mode, in accordance with an aspect of the present disclosure.

FIG. 7 is a schematic of an embodiment of the vapor compression circuit 102 of the HVAC system having the conduit system 122, illustrating operation of the HVAC system 100 in a cooling mode. The illustrated embodiment of the vapor compression circuit 102 includes certain elements and element numbers similar to those described above with reference to FIGS. 5 and 6. For example, the vapor compression circuit 102 includes the compressor 104, the first heat exchanger 106 (e.g., heat exchanger 150), the second heat exchanger 108, and the reversing valve 112. The illustrated embodiment also includes two expansion devices 110 (e.g., a first expansion valve 250 and a second expansion valve 252), which enable operation of the HVAC system 100 in the cooling mode and in a heating mode. The first expansion valve 250 is configured to enable flow of working flow therethrough and to the first heat exchanger 106 (e.g., in a cooling mode), while the second expansion valve 252 is configured to enable flow of working fluid therethrough and to the second heat exchanger 108 (e.g., in a heating mode).

As shown, in the illustrated embodiment, the reversing valve 112 is positioned to enable flow of the working fluid through the vapor compression circuit 102 in a flow direction 254, whereby the working fluid flows sequentially through the compressor 104, the reversing valve 112, the second heat exchanger 108 (e.g., operating as a condenser in the cooling mode), the first expansion valve 250, the first heat exchanger 106 (e.g., operating as an evaporator to cool a supply air flow), the reversing valve 112, and back to the compressor 104. As will be appreciated, the working fluid may not flow through the second expansion valve 252 in the cooling mode. Instead, the vapor compression circuit 102 includes a bypass conduit 256 having a check valve 258 configured to enable flow of working fluid from the second heat exchanger 108 to the first expansion valve 250 in the cooling mode, as indicated by arrow 260.

The vapor compression circuit 102 also includes the conduit system 122 associated with the first heat exchanger 106. As discussed above, the conduit system 122 is configured to enable flow of the working fluid through the first heat exchanger 106 to place the working fluid in a counterflow heat exchange relationship with an air flow (e.g., supply air flow, air flow 116) directed across the first heat exchanger 106. Specifically, the conduit system 122 is configured to enable the counterflow heat exchange relationship between the working fluid directed through the first heat exchanger 106 and an air flow directed thereacross during operation of the HVAC system 100 in the cooling mode, as illustrated in FIG. 6, as well as in the heating, as illustrated in FIG. 7 and described in further detail below.

In the cooling mode, the conduit system 122 is configured to direct the working fluid along the first flow path 186 defined by the conduit system 122. For example, the first flow path 186 may be defined at least partially by the inlet tubes 216, the inlet conduits 180, the outlet conduits 182, the second manifold 178, and/or the first conduit 190. After flowing from the compressor 104 to the second heat exchanger 108, the working fluid may be discharged from second heat exchanger 108 and flow to the second circuit conduit 198 via the check valve 258 of the bypass conduit 256. The second circuit conduit 198 is configured to direct the working fluid to the first expansion valve 250. While the third conduit 196 of the conduit system 122 is fluidly coupled to the second circuit conduit 198, the working fluid may not flow from through the third conduit 196 from the second circuit conduit 198 because the third check valve 204 disposed along the third conduit 196 may block flow of the working fluid from the second circuit conduit 198 and through the third conduit 196 (e.g., toward the first conduit 190). Indeed, a pressure of the working fluid within the second circuit conduit 198 in the cooling mode may bias the third check valve 204 to a closed position to block working fluid flow therethrough.

From the second circuit conduit 198, the working fluid may flow through the first expansion valve 250 (e.g., thereby causing a reduction in pressure of the working fluid) and my flow through the distributor 212, the distributor tubes 214, and the inlet tubes 216. In this way, the working fluid may be directed into the inlet conduits 180 and into tubes of the heat exchanger 106 via the inlet ports 160. While the inlet conduits 180 are fluidly coupled to the first manifold 176 of the conduit system 122, the second check valve 202 disposed along the second conduit 194 of the conduit system 122 may block flow of the working fluid from the inlet conduits 180 to the first conduit 190 of the conduit system 122 via the second conduit 194. Thus, the second check valve 202 blocks the working fluid from bypassing the first heat exchanger 106 in the cooling mode. Instead, the working fluid may flow through the first heat exchanger 106 in the second direction 158 opposite the first direction 156 of an air flow (e.g., supply air flow) directed across the first heat exchanger 106 in the cooling mode.

The working fluid may be discharged from the first heat exchanger 106 via the outlet ports 162 and may flow into the second manifold 178 via the outlet conduits 182. The second manifold 178 may direct the working fluid to the first conduit 190 of the conduit system 122, and the working fluid may flow along the first conduit 190, across the first check valve 200 disposed along the first conduit 190, and to the first circuit conduit 192. The working fluid may then flow along the first circuit conduit 192, through the reversing valve 112, and back to the compressor 104.

It should be noted that, in the cooling mode, the working fluid may not flow from the first conduit 190 to the first manifold 176 via the second conduit 194 and the second check valve 202. As similarly described above regarding the third check valve 204 in the cooling mode, a pressure of the working fluid directed into the inlet conduits 180 fluidly coupled to the first manifold 176 (e.g., upstream of the first heat exchanger 106 relative to flow of working fluid therethrough) may be greater than a pressure of the working fluid discharged from the first heat exchanger 106 and directed along the first conduit 190. Thus, the second check valve 202 may be biased toward a closed position to block flow of working fluid therethrough (e.g., from the first conduit 190 to the first manifold 176 via the second conduit 194). As discussed above, a pressure of the working fluid within the second circuit conduit 198 may bias the third check valve 204 toward a closed position to similarly block flow of the working fluid from the first conduit 190 to the second circuit conduit 198 via the third conduit 196. Therefore, the conduit system 122 may effectively direct the working fluid from the second manifold 178 back to the reversing valve 112 and the compressor 104 via the first circuit conduit 192 in the cooling mode. In the manner described above, the conduit system 122 is configured to establish a counterflow arrangement between the working fluid and an air flow via the first heat exchanger 106 in the cooling mode of the HVAC system 100, which may enable more efficient operation of the HVAC system 100.

Figure 8:
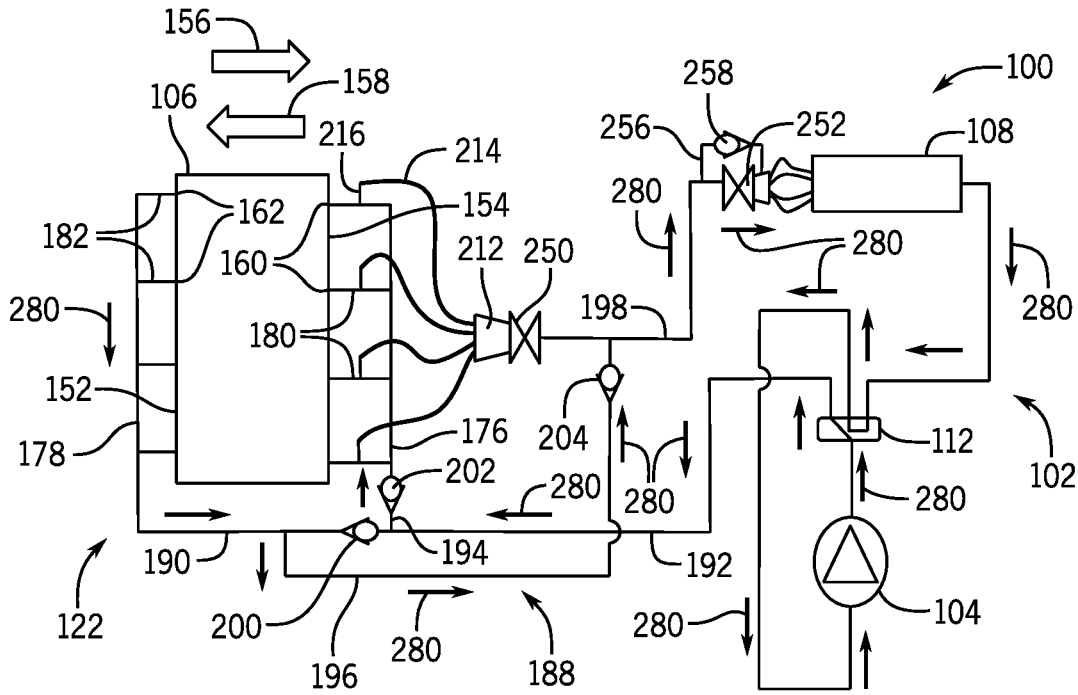
FIG. 8 is a schematic of an embodiment of a portion of a vapor compression circuit of an HVAC system, illustrating operation of the vapor compression circuit in a heating mode, in accordance with an aspect of the present disclosure.

FIG. 8 is a schematic of an embodiment of the vapor compression circuit 102 of the HVAC system having the conduit system 122, illustrating operation of the HVAC system 100 in a heating mode. The illustrated embodiment of the vapor compression circuit 102 includes certain elements and element numbers similar to those described above with reference to FIG. 7. In the illustrated embodiment, the reversing valve 112 is positioned to enable flow of the working fluid through the vapor compression circuit 102 in a flow direction 280, whereby the working fluid flows sequentially through the compressor 104, the reversing valve 112, the first heat exchanger 106 (e.g., operating as a condenser to heat a supply air flow), the second expansion valve 252, the second heat exchanger 108 (e.g., operating as a condenser in the heating mode), the reversing valve 112, and back to the compressor 104. As will be appreciated, the working fluid may not flow through the first expansion valve 250 (e.g., from the second circuit conduit 198 to the distributor 212) in the heating mode due to a pressure difference of the working fluid in the first manifold 176 and the working fluid in the second circuit conduit 198. In some embodiments, the first expansion valve 250 may be closed (e.g., via a control system, such as control board 48) in the heating mode.

As discussed above with reference to FIG. 7, the vapor compression circuit 102 includes the conduit system 122 associated with the first heat exchanger 106, and the conduit system 122 is configured to enable flow of the working fluid through the first heat exchanger 106 to place the working fluid in a counterflow heat exchange relationship with an air flow (e.g., supply air flow, air flow 116) directed across the first heat exchanger 106. In the heating mode, the conduit system 122 is configured to direct the working fluid along the second flow path 188 defined by the conduit system 122. For example, the second flow path 188 may be defined at least partially by the first conduit 190, the second conduit 194, the first manifold 176, the inlet conduits 180, the outlet conduits 182, the second manifold 178, and/or the third conduit 196.

After flowing from the compressor 104, the working fluid may be directed through the first circuit conduit 192 and the first conduit 190 to the second conduit 194. The first check valve 200 disposed along the first conduit 190 may block flow of the working fluid further along the first conduit 190 toward the second manifold 178. Thus, the working fluid may instead flow along the second conduit 194, across the second check valve 202, and into the first manifold 176. From the first manifold 176, the working fluid may be directed through the inlet conduits 180 into the tubes of the first heat exchanger 106 via the inlet ports 160 at the second end 154 of the first heat exchanger 106. As mentioned above, the working fluid may not flow from the inlet conduits 180 toward the first expansion valve 250 via the distributor tubes 214 due to a pressure difference between the working fluid within the inlet conduits 180 and the working fluid within the second circuit conduit 198. Thus, the working fluid may flow through the tubes of the first heat exchanger 106 in the second direction 158 opposite the first direction 156 of the air flow directed across the first heat exchanger 106, thereby establishing a counterflow arrangement between the working fluid and the air flow in the heating mode.

The working fluid may be discharged from the first heat exchanger 106 via the outlet ports 162 and may flow into the second manifold 178 via the outlet conduits 182. The second manifold 178 may direct the working fluid to the first conduit 190 of the conduit system 122. However, the working fluid within the first conduit 190 may not flow across the first check valve 200 disposed along the first conduit 190. Indeed, a pressure of the working fluid discharged by the compressor 104 and directed along the first conduit 190 toward the second conduit 194 may be greater than a pressure of the working fluid directed from the second manifold 178 to the first conduit 190. In other words, the pressure of the working fluid discharged by the compressor 104 and directed along the first conduit 190 toward the second conduit 194 may bias the first check valve 200 toward a closed position. Therefore, the working fluid may flow from the first conduit 190 into the third conduit 196. Within the third conduit 196, the working fluid may flow across the third check valve 204 and be directed to the second circuit conduit 198. The working fluid may flow along the second circuit conduit 198 and through the second expansion valve 252 to the second heat exchanger 108. The check valve 258 of the bypass conduit 256 may block bypass of the second expansion valve 252 by the working fluid. From the second heat exchanger 108, the vapor compression circuit 102 may direct the working fluid back through the reversing valve 112 to the compressor 104. In the manner described above, the conduit system 122 is configured to establish a counterflow arrangement between the working fluid and an air flow via the first heat exchanger 106 in the heating mode of the HVAC system 100, which may enable more efficient operation of the HVAC system 100. It should be appreciated that an embodiment of the conduit system 122 may additionally or alternatively be incorporated with the vapor compression circuit 102 and associated with the second heat exchanger 108 to provide similar functionality and benefits as those discussed above with reference to the first heat exchanger 106.

As discussed in detail above, the conduit system 122 is configured to establish a counterflow arrangement between the working fluid and an air flow via the first heat exchanger 106 in the cooling mode of the HVAC system 100 and in the heating mode of the HVAC system 100, which may enable more efficient operation of the HVAC system 100 in both modes, as well as more efficient overall operation of the HVAC system 100. That is, the HVAC system 100 (e.g., central HVAC system, heat pump) may operate in the cooling mode and in the heating mode with improved heat transfer efficiency, improved energy efficiency, and/or reduced energy consumption. Indeed, the HVAC systems disclosed herein are configured to operate with reduced greenhouse gas emissions by operating to heat and cool an air flow in an energy efficient manner and without operation of a furnace or other system that consumes a fuel. As will be appreciated, the conduit system 122 described herein may be implemented in a cost-effective manner. For example, the conduit system 122 includes components such as the first conduit 190, the second conduit 194, the third conduit 196, the first manifold 176, the second manifold 178, and the check valves 200, 202, and 204, which may be passively controlled components. In other words, the components of the conduit system 122 may not be operated via a control system, other programmable structure, sensors, and/or other electrical components that may increase costs associated with manufacture, maintenance, and/or operation of the HVAC system 100. Further, the disclosed embodiments and techniques enable improvements in heat transfer and energy efficiency of the HVAC system 100 without increasing a size or heat transfer area of the first heat exchanger 106 and/or second heat exchanger 108 and without increasing a size of the HVAC system 100 generally (e.g., a cabinet or housing of the HVAC system 100 having the first heat exchanger 106 and/or second heat exchanger 108), thereby further reducing costs associated with improvements in heat transfer and energy efficiency.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An energy efficient heat pump for a heating, ventilation, and air conditioning (HVAC) system, comprising:

a vapor compression circuit;

a heat exchanger of the vapor compression circuit configured to place a working fluid in a heat exchange relationship with an air flow directed across the heat exchanger; and a conduit system of the vapor compression circuit configured to receive the working fluid from the heat exchanger via a first flow path of the conduit system and to direct the working fluid into the heat exchanger via a second flow path of the conduit system, wherein the conduit system comprises a third flow path extending from the first flow path to the second flow path, and wherein the conduit system is configured to direct the working fluid into the heat exchanger to place the working fluid in a counterflow arrangement with the air flow directed across the heat exchanger in a cooling mode of the heat pump and in a heating mode of the heat pump, and the first flow path of the conduit system is configured to receive the working fluid from the heat exchanger in the cooling mode of the heat pump and in the heating mode of the heat pump.

2. The energy efficient heat pump of claim 1, wherein the conduit system comprises a first manifold configured to direct the working fluid into tubes of the heat exchanger and a second manifold configured receive the working fluid from the tubes of the heat exchanger.

3. The energy efficient heat pump of claim 2, wherein the vapor compression circuit comprises an expansion valve and a compressor, the first manifold is configured to receive the working fluid from the expansion valve in the cooling mode, and the first manifold is configured to receive the working fluid from the compressor in the heating mode.

4. The energy efficient heat pump of claim 3, wherein the expansion valve is a first expansion valve, the vapor compression circuit comprises a second expansion valve, the second manifold is configured to direct the working fluid from the heat exchanger toward the compressor in the cooling mode, and the second manifold is configured to direct the working fluid from the heat exchanger toward the second expansion valve in the heating mode.

5. The energy efficient heat pump of claim 4, wherein the conduit system comprises:

a first check valve disposed along the first flow path, wherein the first check valve is configured to enable flow of the working fluid from the second manifold to the compressor in the cooling mode; and a second check valve configured to block flow of the working fluid from the first manifold to the compressor in the cooling mode.

6. The energy efficient heat pump of claim 5, wherein:

the first check valve is configured to block flow of the working fluid from the compressor to the second manifold in the heating mode, and the second check valve is configured to enable flow of the working fluid from the compressor to the first manifold in the heating mode.

7. The energy efficient heat pump of claim 6, wherein the heat exchanger is a first heat exchanger, the vapor compression circuit comprises a second heat exchanger, the conduit system comprises a third check valve, wherein the third check valve is configured to block flow of the working fluid from the second heat exchanger to the second manifold in the cooling mode, and the third check valve is configured to enable flow of the working fluid from the second manifold to the second expansion valve in the heating mode.

8. The energy efficient heat pump of claim 3, wherein the first manifold comprises a header and a plurality of inlet conduits extending from the header to the tubes of the heat exchanger, the vapor compression circuit comprises a distributor extending between the expansion valve and the plurality of inlet conduits, the distributor is configured to direct the working fluid from the expansion valve to the plurality of inlet conduits in the cooling mode, and the conduit system is configured to direct the working fluid from the compressor to the header in the heating mode.

9. The energy efficient heat pump of claim 1, comprising a fan configured to force the air flow across the heat exchanger in a first direction in the cooling mode and in the first direction in the heating mode.

10. An energy efficient heat pump for a heating, ventilation, and air conditioning (HVAC) system, comprising:

a vapor compression circuit; and a heat exchanger disposed along the vapor compression circuit, wherein the heat exchanger comprises an inlet, an outlet, and a plurality of tubes configured to direct a working fluid therethrough, and the heat exchanger is configured to place the working fluid in a heat exchange relationship with an air flow directed across the heat exchanger in a first direction, and wherein the heat exchanger is configured to direct the working fluid through the heat exchanger in a second direction opposite the first direction in a heating mode and in a cooling mode of the heat pump, wherein the vapor compression circuit is configured to direct the working fluid from the plurality of tubes via a first flow path fluidly coupled to the outlet in the heating mode and in the cooling mode, and the vapor compression circuit configured to direct the working fluid into the heat exchanger via a second flow path fluidly coupled to the inlet in the cooling mode, and wherein the vapor compression circuit comprises a third flow path extending from the first flow path to the second flow path.

11. The energy efficient heat pump of claim 10, wherein:

the heat exchanger comprises a first end and a second end opposite the first end, the heat exchanger is configured to receive the air flow via the first end and discharge the air flow via the second end in the heating mode and in the cooling mode, and the inlet is disposed adjacent the second end and the outlet is disposed adjacent the first end.

12. The energy efficient heat pump of claim 10, wherein the heat exchanger is a first heat exchanger, and the heat pump comprises:

a compressor disposed along the vapor compression circuit;

an expansion valve disposed along the vapor compression circuit; and a second heat exchanger disposed along the vapor compression circuit, wherein the vapor compression circuit is configured to direct the working fluid from the expansion valve to the inlet in the cooling mode and is configured to direct the working fluid from the compressor to the inlet in the heating mode.

13. The energy efficient heat pump of claim 12, wherein the vapor compression circuit comprises a first check valve disposed along the first flow path, and the first check valve is configured to block flow of the working fluid from the compressor to the outlet.

14. The energy efficient heat pump of claim 13, wherein the vapor compression circuit defines a fourth flow path extending from the first flow path to the inlet, the vapor compression circuit comprises a second check valve disposed along the fourth flow path, and the second check valve is configured to block flow of the working fluid from the inlet to the first flow path.

15. The energy efficient heat pump of claim 13, wherein the vapor compression circuit comprises a second check valve disposed along the third flow path, and the second check valve is configured to block flow of the working fluid from the second heat exchanger to the first flow path along the third flow path.

16. The energy efficient heat pump of claim 12, wherein the heat pump is a packaged unit including the first heat exchanger and the second heat exchanger, the packaged unit is configured to direct an ambient air flow across the second heat exchanger, the packaged unit is configured to direct a supply air flow across the first heat exchanger as the air flow, and the packaged unit is configured to discharge the supply air flow toward a conditioned space.

17. An energy efficient heat pump for a heating, ventilation, and air conditioning (HVAC) system, comprising:

a vapor compression circuit comprising a compressor, a first heat exchanger, a second heat exchanger, and an expansion valve, wherein the first heat exchanger comprises an inlet configured to receive a working fluid from the vapor compression circuit, a plurality of tubes configured to circulate the working fluid through the first heat exchanger, and an outlet configured to discharge the working fluid from the first heat exchanger, and wherein the vapor compression circuit comprises a conduit system configured to direct the working fluid into the plurality of tubes via the inlet in a heating mode of the heat pump and in a cooling mode of the heat pump, wherein the conduit system comprises:

a first flow path extending from the outlet to the compressor, wherein the first flow path is configured to receive the working fluid from the outlet of the first heat exchanger in the heating mode of the heat pump and in the cooling mode of the heat pump;

a second flow path extending from the second heat exchanger to the expansion valve; and a third flow path extending from the first flow path to the second flow path.

18. The energy efficient heat pump of claim 17, comprising a fan configured to force an air flow across the first heat exchanger in a first direction in the heating mode of the heat pump, wherein the fan is configured to force the air flow across the first heat exchanger in the first direction in the cooling mode of the heat pump.

19. The energy efficient heat pump of claim 17, wherein the conduit system comprises:

a fourth flow path extending from the first flow path to the inlet.

20. The energy efficient heat pump of claim 19, wherein the conduit system comprises:

a first check valve disposed along the first flow path and configured to block flow of the working fluid from the compressor to the outlet;

a second check valve disposed along the fourth flow path and configured to block flow of the working fluid from the inlet to the first flow path; and a third check valve disposed along the third flow path and configured to block flow of the working fluid from the second flow path to the first flow path.

* * * * *